United States Patent [19]

Dickson et al.

[11] Patent Number: 4,908,987

[45] Date of Patent: Mar. 20, 1990

[54] PET PORTAL

[76] Inventors: Richard Dickson; Lynne Dickson, both of Stone Ridge, N.Y. 12484

[21] Appl. No.: 282,591

[22] Filed: Dec. 12, 1988

[51] Int. Cl.[4] ..... E06B 7/28

[52] U.S. Cl. ..... 49/169; 49/274; 49/263

[58] Field of Search ..... 49/169, 171, 404, 445, 49/447, 274, 263, 273; 43/64–68, 73, 76; 119/55, 19

[56] References Cited

U.S. PATENT DOCUMENTS

| | | | |
|---|---|---|---|
| 1,036,658 | 8/1912 | Andowski | 49/445 |
| 1,442,553 | 1/1923 | Wood | 49/169 |
| 3,575,141 | 4/1971 | Elkins | 119/55 |

*Primary Examiner*—Kenneth J. Dorner
*Assistant Examiner*—Gerald A. Anderson

[57] ABSTRACT

A pet portal for use on a door, with an opening cut in it, permitting a pet, such as a cat or a dog, to enter a house without having to have anyone open the door for them. The pet portal includes a horizontal panel mounted on a slidably mounted vertical panel. The horizontal panel extends both inside and outside the door with an actuating means for pulling the horizontal panel and the vertical panel up to the top of the opening in the door so that the vertical panel covers the opening in the door. Both the vertical and horizontal panels slide downwardly against the actuating means when a pet steps on the horizontal panel either inside or outside of the door.

4 Claims, 3 Drawing Sheets

PET PORTAL

BACKGROUND OF THE INVENTION

1. Field of the Invention

The present invention relates to pet portals, and more particularaly is directed to a pet portal which is simple to construct, and which can be readily built in kit form for placement on a door leading to the outside of the building where the pet resides. The pet portal included an actuating means for lifting a vertical panel up and down with a horizontal panel, on which the pet can sit, affixed to the vertical panel. The weight of the pet overcomes the force of the actuating means and pushes the vertical panel and horizontal panel downwardly thereby uncovering the opening in the door to permit the pet to pass through the opening.

2. Description of the Prior Art

Various patents have been issued for pet portals of various types. Such devices, although showing a usable device, are more complicated and expensive to build than the device proposed by applicants, which is very simple and inexpensive to build and which works with perfect dependability and closes the opening when not in use to prevent loss caused by exposure of the inside of the building to the outside elements.

The novel features which are considered as characteristics of the invention are set forth with particularity in the appending claims.

The invention itself, however, as to its construction and obvious advantages, will be best understood from the following description of the specific embodiment, when read with the accompanying drawings.

SUMMARY OF THE INVENTION

The present invention overcomes the disadvantages of the previous designs of pet portals by providing an opening through an existing door with a pair of slide channels on both sides of the opening. A vertical panel is slidably mounted in the slide channels to cover and uncover the opening in the door. A horizontal panel is affixed to the top of the vertical panel and extends both inside and outside of the opening in the door. An actuating means pulls the horizontal and vertical panels upwardly when not in use, but when a pet places itself on the horizontal panel both the horizontal panel and vertical panel slide downwardly against the force of the actuating means.

DESCRIPTION OF THE DRAWINGS

The present invention may be better understood and its numerous advantages will be apparent to those skilled in the art by referring to the accompaning drawings, wherein like reference numerals refer to the elements in the various figures in which.

DETAILED DESCRIPTION OF THE INVENTION

Figure 1:
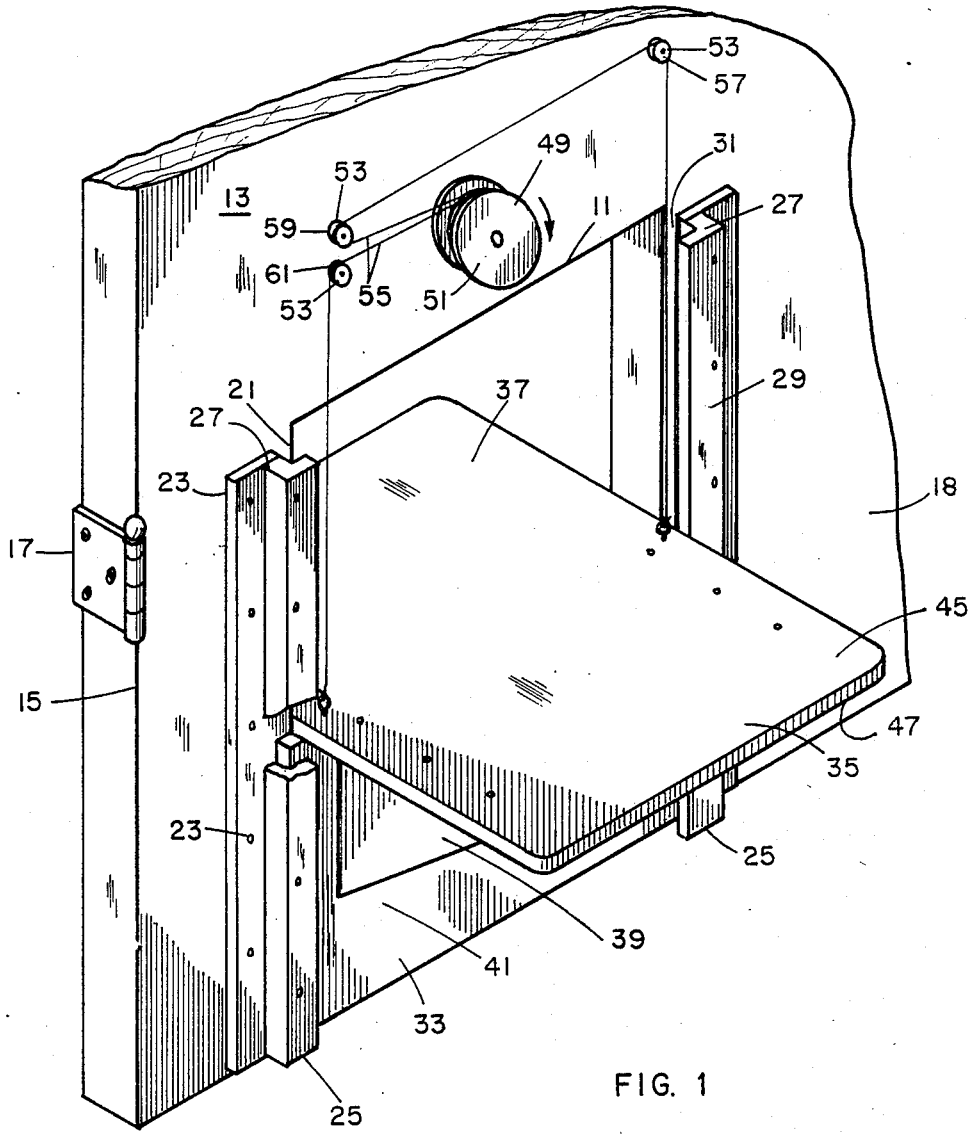
FIG. 1 is a perspective view of a portion of the inside of a door showing the inside of the pet portal partially open and showing the slide channel and the actuating means affixed to the door.
Figure 2:
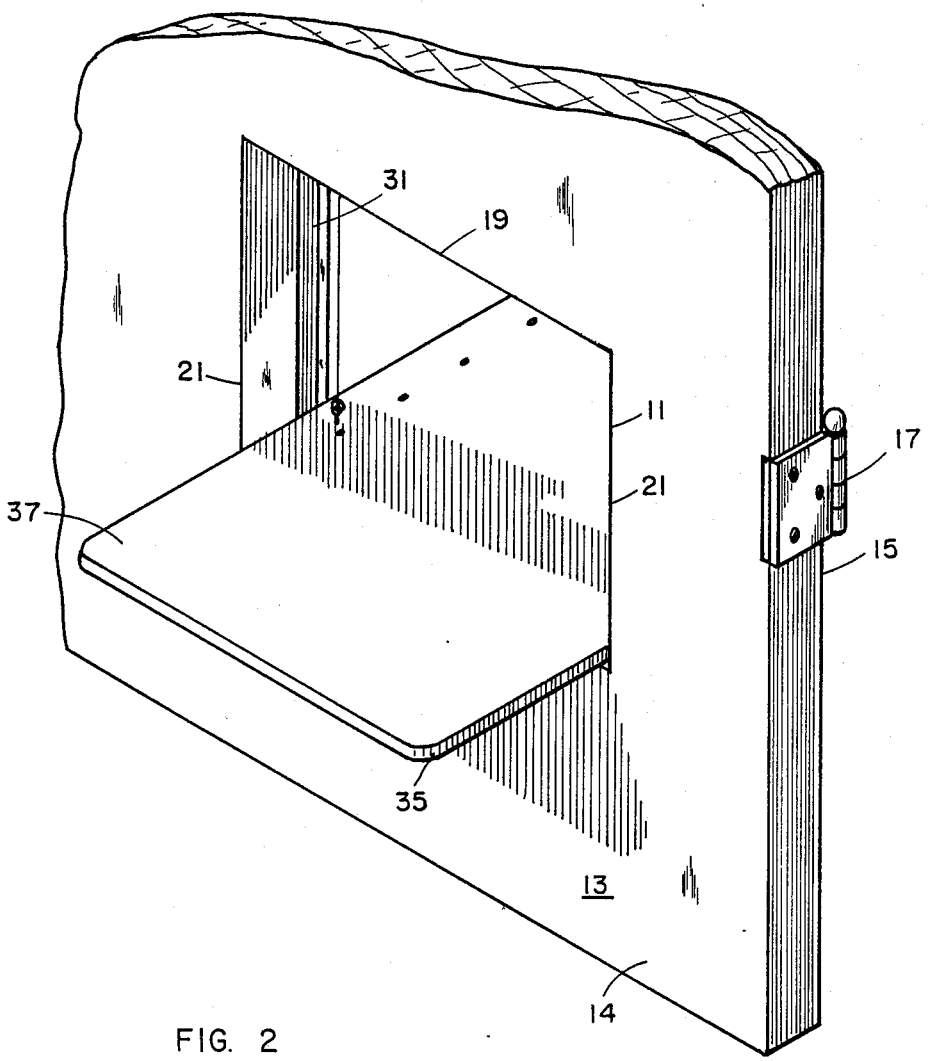
FIG. 2 is a perspective view of a portion of the outside of a door showing the outside of the pet portal fully open.
Figure 3:
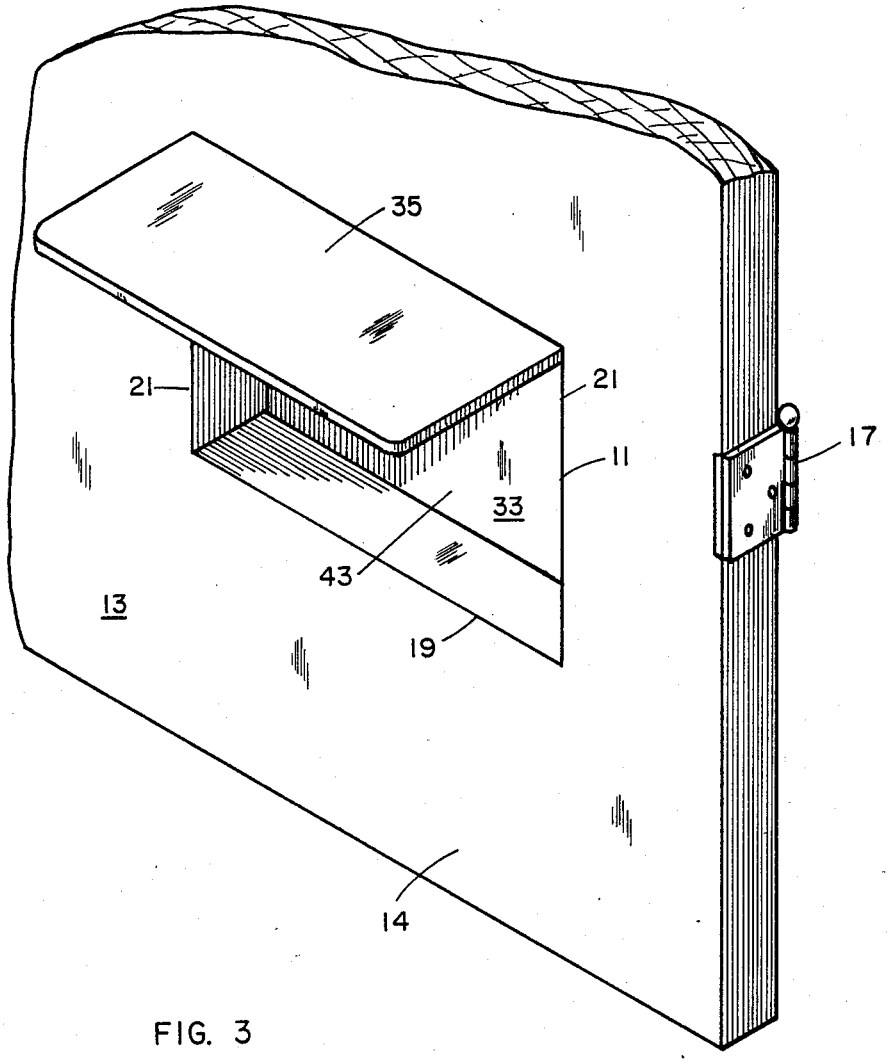
FIG. 3 is a perspective view of a portion of the outside of a door showing the outside of the pet portal fully closed.

As best seen in FIG. 1 an opening 11, preferably of a rectangular shape, is first cut in a corner of a door 13. The door 13 would be a door 13 to the outside of whatever building, such as a house, in which the door 13 was located and would have an outside surface 14. The most advantageous place to insert such an opening 11 is in the lower part of the door 13, close to the hinge edge 15, so that the weight of the pet portal, although it is not of a substantial amount, has the least adverse effect upon the hinges 17. The pet portal is preferably mounted on the inside surface 18 of the door 13 opposite from the outside surface 14. By such a location of the pet portal, it also is sufficiently low to permit ready use by a small pet, such as a cat.

The opening 11 through the door 13 is preferably rectangular and also the larger pair of sides 19 are preferably horizontal, and the smaller pair of sides 21 of the rectangular opening 11 are preferably vertical. Along the smaller vertical sides 21 of the opening 11, flat blocks 23 are placed, such, for example being a readily obtainable board approximately ¾ of an inch thick and 3 inches wide, with its length determined by the size of the opening 11. The flat blocks 23 can be affixed to the door 13 by any suitable fastening means such as screws 24. Affixed to the flat blocks 11 is an L-shaped member 25, with a perpendicular part 27 of the L-shaped member 25, being perpendicular to the flat blocks 23, and a parallel part 29 of the L-shaped member 25 being parallel to the flat blocks 23. The perpendicular part 27, of the L-shaped member 25 is, of course, rigidly connected to its respective flat block 23. In this way, a guide 31 is formed between the flat blocks 23 and the parallel parts 29 of the L-shaped member 25. The L-shaped members 25 can be readily affixed to the flat blocks 23 by screws (not shown) through the back of the flat blocks 23. A vertical panel 33 is slidably mounted in the guide 31 and extends between the perpendicular parts of the L-shaped members 25. The size of the vertical panel 33 is also such as to cover the opening 11 that has already been cut in the door 13. The vertical panel 33 would also be made, from standard wood stock of approximately a ¾ inch thickness, with its rectangular shape being determined by the size of the opening 11 in the door 13.

A horizontal panel 35 then is rigidly affixed to the vertical panel forming a slidable platform. The horizontal panel 35 is affixed to the vertical panel 33, substantially at the midpoint of the horizontal panel 35, so that approximately half of the horizontal panel 35 will extend out of the opening 11 in the door 13 beyond the outside surface 14 of the door 13, and the other half will be outwardly of the inside surface 18 of the door 13. The horizontal panel 35 forms a seat on which the pet can place itself when either by the outside surface 14 or inside surface 18 of the door 13. The combination of the vertical panel 33 and the horizontal panel 35 forms a platform 37. The width of the horizontal panel 35 is such as to extend between the parallel parts 19 of the pair of shaped members 25 and is not slidably mounted in the guide 31. Therefore, the horizontal panel 35 has a width slightly smaller than the width of the vertical panel 35, which must extend into the guides 31 and not just up to the guide 31.

In order properly to secure the horizontal panel 35 to the vertical panel 33 a bracket 39 such as a triangularlyshaped member, is preferably placed between the vertical panel 33 and the horizontal panel 35. The vertical panel 33 has both an inside surface 41 and an outside surface 43. The inside surface 41 faces in the same manner as the inside surface 18 of the door 13, and the outside surface 43 of the vertical panel 33 faces in the same manner as the outside surface 14 of the door 13. Preferably, the bracket (not shown) would be located on the inside surface 41 of the vertical panel 33. The horizontal panel 35 has both an upper surface 45, on which the pet would place itself, and a lower surface 47, opposite from the upper surface 45. The bracket would also be connected to the lower surface 47 of the horizontal panel 35.

An actuating means 49 is used to pull upwardly the platform 37 when not in use. The actuating means 49 is of such a predetermined strength that the weight of the pet using the pet portal will force the platform 37 to slide downwardly when the pet sits upon the upper surface 45 of the horizontal panel 35 when either at the inside surface 18 of the door 13, or at the outside surface 14 of the door 13. The actuating means 49 is preferably located on the inside surface 14 of the door 13 to prevent damage to the actuating means 49 from the elements, but could also be placed on the outside surface 14 of the door 13.

A preferable form of actuating means 49 is a spring-loaded pulley 51, which is best seen in FIG. 1. The spring (not shown) in the spring-loaded pulley 51 causes the spring-loaded pulley 51 to rotate in a clockwise direction (as one faces the spring-loaded pulley 51) pulling the platform 37 upwardly. As can be seen, three idling pulleys 33 are used with two cables 55 for this purpose. One cable 55 extends from the right side (as one faces the inside surface 14 of the door 18), as shown in FIG. 1, upwardly over a first idler pulley 57, around a second idler pulley 59 and back around the spring-loaded pulley 51. The other cable 55 is connected to the other side or left side (as one faces the inside surface 18 of the door 13) of the horizontal panel 35 and extends around a third idler pulley 61 to the spring-loaded pulley 51.

As can be readily seen, when a pet places itself upon the horizontal panel 35, the strength of the spring in the spring-loaded pulley 51 is overcome and the platform 37 will slide downwardly, permitting the pet to step through the opening 11, leap off the horizontal panel 35, and then the entire pet portal will again close. The animal can repeat the same process in the opposite direction.

While a preferred embodiment has been shown and described, various modifications and substitutions may be made without departing from the spirit and scope of this invention. Accordingly, it is understood that this invention has been described by way of illustration rather than limitation.

I claim:

1. A pet portal for use in permitting an animal to exit and enter a building through a closed door having an inside surface inside the building and an outside surface outside of the building, said door having a rectangular opening through it, said pet portal comprising:

a pair of guide means including a pair of flat blocks vertically affixed to the inside surface of the door and a pair of L-shaped members affixed to the pair of flat blocks to form a channel, said pair of guide means being adjacent to the sides of the rectangular opening in the door;

a platform including a vertical panel slidably mounted in the pair of guide means, the vertical panel being substantially parallel with the door, and having an upper edge, and an inside surface, and a outside surface, the inside surface facing inside the building, and the outside surface facing outside the building, the vertical panel having a size and shape substantially the same as the opening in the door, the platform further including a horizonal panel extending between the pair of guide means and substantially the same distance beyond both the inside surface and the outside surface of the door, said horizontal panel having a lower surface and an upper surface, the lower surface of the horizontal panel being affixed to the upper edge of the vertical panel;

a spring-loaded pulley affixed to the inside of the door above the opening in the door;

a plurality of idler pulleys affixed to the inside of the door; and a pair of cables wound around the spring-loaded pulley passing over pulleys and connected to the horizontal panel adjacent the pair of guide means, the spring-loaded pulley having sufficient strength to pull up the platform to cover the opening in the door and to permit the platform to slide downwardly with a pet upon the horizontal panel.

2. A pet portal for use in permitting an animal to exit and enter a building through a closed door having an inside surface inside the building and an outside surface outside of the building, said door having an opening through it, said pet portal comprising:

a pair of guide means, said pair of guide means being adjacent to the opening in the door;

a platform including a vertical panel slidably mounted in the pair of guide means, the vertical panel being substantially parallel with the door, and having an upper edge, and an inside surface, and an outside surface, the inside surface facing inside the building, and the outside surface facing outside the building, the vertical panel having a size and shape substantially the same as the opening in the door, the platform further including a horizontal panel extending between the pair of guide means and substantially the same distance beyond both the inside surface and the outside surface of the door, said horizontal panel having a lower surface and an upper surface, the lower surface of the horizontal panel being affixed to the upper edge of the vertical panel;

a spring-loaded pulley affixed to the inside of the door above the opening in the door;

pulley means affixed to the inside of the door; and a pair of cables wound around the spring-loaded pulley passing over the pulley means and connected to the horizontal panel adjacent the pair of guide means, the spring-loaded pulley having sufficient strength to pull up the platform to cover the opening in the door and to permit the platform to slide downwardly with a pet upon the horizontal panel.

3. A pet portal for use in permitting an animal to exit and enter a building through a closed door having an inside surface inside the building and an outside surface outside of the building, said door having an opening through it, said pet portal comprising:

a pair of guide means, said pair of guide means being adjacent to the opening in the door;

a platform including a vertical panel slidably mounted in the pair of guide means, the vertical panel being substantially parallel with the door, and having an upper edge, and an inside surface, and an outside surface, the inside surface facing the inside the building, and the outside surface facing outside the building, the vertical panel having a size and shape substantially the same as the opening in the door, the platform further including a horizontal panel extending between the pair of guide means and substantially the same distance beyond both the inside surface and the outside surface of the door, said horizontal panel having a lower surface and an upper surface, the lower surface of the horizontal panel being affixed to the upper edge of the vertical panel;

and a platform actuating means affixed to the surface of the door and connected to the platform, the actuating means having sufficient strength to pull up the platform to cover the opening in the door and to permit the platform to slide downwardly with a pet upon the horizontal panel.

4. A pet portal according to claim 3 wherein the pair of guide means includes a pair of L-shaped members forming a pair of grooves along the opposite sides in the opening in the door.

* * * * *